US006695074B2

(12) United States Patent
Nackerud

(10) Patent No.: US 6,695,074 B2
(45) **Date of Patent: *Feb. 24, 2004**

(54) METHOD AND APPARATUS FOR ENLARGING WELL BORES

(76) Inventor: Alan L. Nackerud, 9957 Titan Park Cir., Littleton, CO (US) 80125

( * ) Notice: Subject to any disclaimer, the term of this patent is extended or adjusted under 35 U.S.C. 154(b) by 0 days.

This patent is subject to a terminal disclaimer.

(21) Appl. No.: 09/962,363

(22) Filed: Sep. 25, 2001

(65) Prior Publication Data

US 2002/0050408 A1 May 2, 2002

Related U.S. Application Data

(63) Continuation-in-part of application No. 09/699,172, filed on Oct. 27, 2000.

(51) Int. Cl.[7] ..... E21B 10/66

(52) U.S. Cl. ..... 175/57; 175/259; 175/265; 175/292

(58) Field of Search ..... 175/258, 259, 175/263, 265, 267, 292

(56) References Cited

U.S. PATENT DOCUMENTS 5,385,205 A * 1/1995 Hailey ..... 175/267
5,494,121 A 2/1996 Nackerud
6,454,024 B1 * 9/2002 Nackerud ..... 175/57

* cited by examiner

*Primary Examiner*—William Neuder
(74) *Attorney, Agent, or Firm*—John E. Reilly

(57) ABSTRACT

A reaming tool for enlarging an earth bore in a subsurface formation in which a sub is connected to a lower end of a drill string and elongated cutter blades are pivotally secured to a lower end of the body which have cutter elements preferably in the form of rotatable cutter disks along their leading edges and a fluid delivery hose leads into fluid passages in each of the cutter blades to supply fluid under pressure to a series of fluid discharge nozzles associated with the cutter elements.

29 Claims, 9 Drawing Sheets

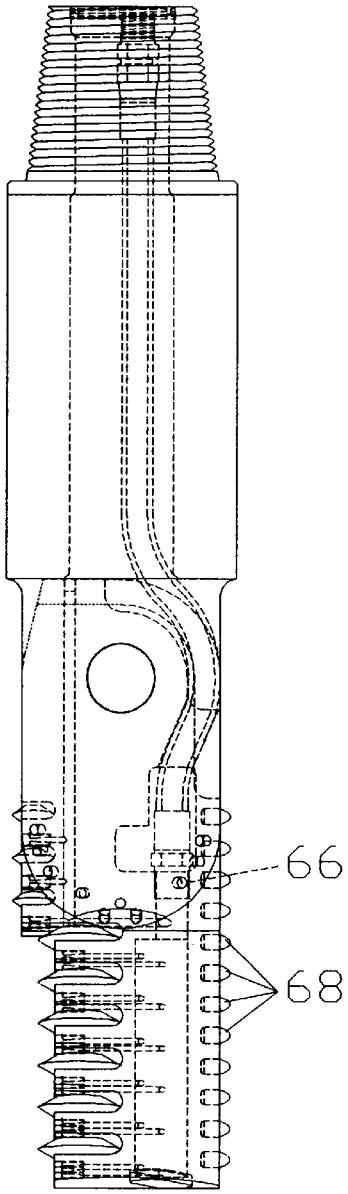
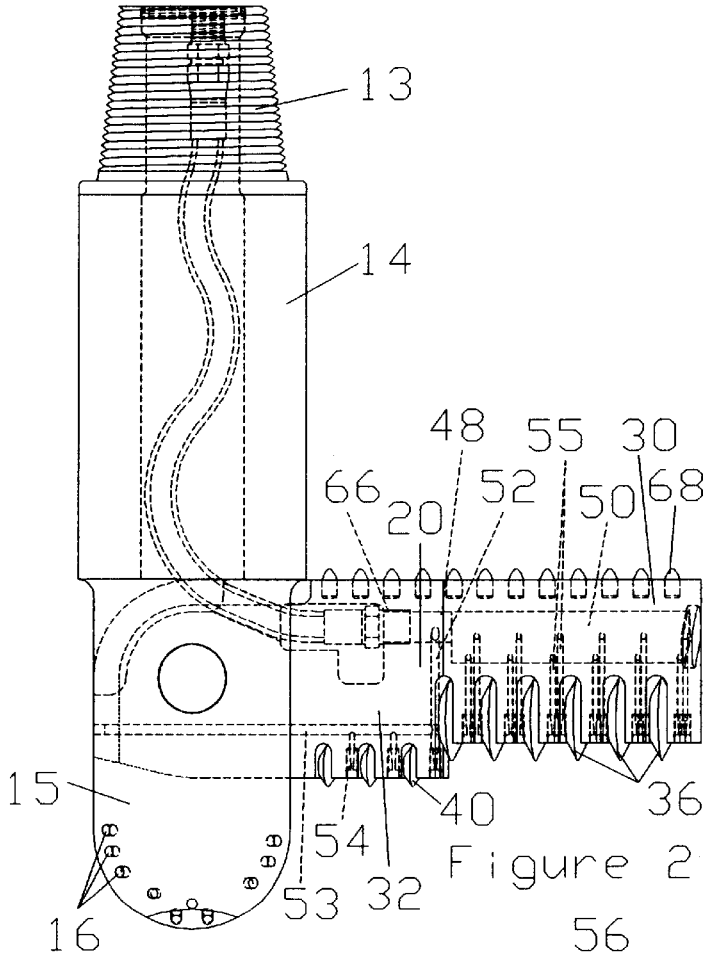
Figure 2
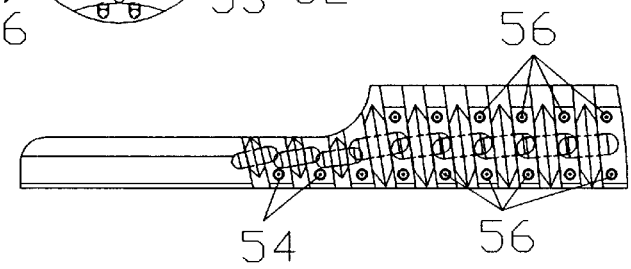
Figure 3
Figure 4

METHOD AND APPARATUS FOR ENLARGING WELL BORES

CROSS REFERENCE TO RELATED APPLICATION

This application is a continuation-in-part of patent application Ser. No. 09/699,172, filed Oct. 27, 2000 for REPLACEABLE DRILL BIT ASSEMBLY by Alan L. Nackerud.

BACKGROUND AND FIELD OF INVENTION

This invention relates to reaming devices; and more particularly relates to a novel and improved method and apparatus for underreaming well bores and caverns and which is specifically adaptable for use in hard rock subsurface formations.

In conventional open hole completion, the well bore is drilled into the top portion of the productive formation and casing is run to the top of the productive formation and cemented in place. The well bore is then deepened through the productive formation and left open to communicate with the interior of the well bore. Generally, this method establishes more communication with the well bore than a conventional cased hole. The types of completion described are somewhat effective in formations with high permeability. However, with the recent increased number of well completions in formations having low permeability or low reservoir pressure, low production flow rates have resulted with long economic payout periods and unsatisfactory rates of return on investment. The reserves in place may be substantial, but the production flow rates are usually unsatisfactory. The conventional types of completion described provide insufficient productive formation surface area to communicate with the well bore. Further, there is insufficient well bore volume for efficient production or for the use of other downhole equipment; and do not increase well bore diameters enough to enable ease of intersection with other well bores.

I have previously devised reaming devices, such as, for example, that disclosed in U.S. Pat. No. 5,494,121 for CAVERN WELL COMPLETION METHOD AND APPARATUS. However, there is a previously unmet need for reaming tools which can be mounted at the lower end of a drill string for the purpose of carrying out high speed earth bore enlarging operations as well as for cavern well completions in hard rock formation with or without fluid assist and with or without rotatable cutter disks, stationary cutting teeth or other inserts.

It is therefore desirable to provide for a method and apparatus for substantially increasing the surface area of the production formation and volume area of the well bore in such a way as to result in substantially increased production rates and to overcome the numerous problems and drawbacks inherent in conventional open hole and cased hole completions as well as subsequent enhancement treatments. In particular, it is proposed to employ a novel and improved reaming device for enlarging a well bore diameter at the productive formation which is characterized by its ease of installation, operation, versatility and reliability in use.

SUMMARY OF THE INVENTION

It is an object of the present invention to provide for a novel and improved reaming tool for earth bore enlargement and cavern well completion operations which is highly versatile and efficient and durable in use.

Another object of the present invention is to provide for a novel and improved reaming tool adopted to be mounted on a conventional drill string and which employs a combination of cutter elements and jet discharge nozzles selectively positioned along the length of one or more cutter blades to achieve a uniform cutting force along the length of each blade.

A further object of the present invention is to provide for a novel and improved reaming tool which employs a unique combination of cutting inserts and fluid passages to carry out downhole cutting operations and specifically wherein the cutting elements may be employed alone or in combination with fluid pressure to perform different cutting and kerfing operations.

It is a still further object of the present invention to provide for a novel and improved reaming tool made up of pivotal cutter blades which employ a unique combination of cutter elements and fluid passages selectively oriented and spaced along the cutting edge of each blade to maximize cutting performance and speed.

In accordance with the present invention, a reaming tool has been devised for enlarging an earth bore in a subsurface formation wherein rotational drive means is lowered through the earth bore to a point at which it is desired to underream or enlarge the bore and wherein a plurality of elongated cutter blades are pivotally secured to a lower end of said drive means. Each of the cutter blades has a series of cutter disks mounted for rotation independently of the blades along a surface of the blade-engaging formation. Fluid delivery means communicates with a fluid circulation passage in each blade for delivery of fluid under pressure therethrough. A plurality of fluid discharge jets extend from said passage to expel fluid from said surface. The blades include radially inner and outer offset portions along a surface of each blade adapted to move into engagement with the formation, each of the offset portions including cutting members thereon.

In a preferred form, the cutter elements include a plurality of rotatable cutter disks which are disposed at radially spaced intervals along the length of each cutter blade, each disk oriented for rotation about an axis on the radius of curvature of the circular path of travel traced by each respective disk; and each cutting blade has offset cutting edges defined by radially spaced smaller cutter disks and larger cutter disks, respectively. In addition, an increased number of jet discharge nozzles is provided along the outer offset edge relative to those provided along the inner offset edge as a result of the greater area traversed by the outer edge. Still further, the nozzle locations are staggered with respect to the cutting element locations so that the cutting elements break up the material between the kerf lines formed by the nozzles. For example, if the nozzles are disposed only along one of the blades and the cutting elements disposed along the other of the blades, the cutting elements will break up that formation material between the kerf lines formed by the nozzles on the one cutting blade. If the cutting elements are positioned on both blades, they are preferably staggered with respect to one another so as to engage different radial distances in the formation between the kerf lines. Correspondingly, if the nozzles are positioned along both blades, they are offset with respect to one another to form kerf lines at different radial distances and thereby achieve enhanced cutting action. The number and spacing of cutting elements and nozzles along the offset edges will of course vary with the hardness of material being drilled, hole size and velocity of the fluid discharge.

The preferred method of reaming in a subsurface formation comprises the steps of lowering a plurality of cutter blades through the earth bore to a point at which it is desired to enlarge the bore, rotating the blades to cause them to swing outwardly into engagement with the wall of the bore, discharging a high velocity stream of fluid through a plurality of nozzles in at least one of the blades wherein a series of kerf lines are formed in concentric circles, placing a series of cutter elements on at least one other of the blades to break up the formation material between the kerf lines formed by the jet streams through the nozzles and orienting the elements to follow or track the kerf lines formed by the nozzles to assist in breaking up the rock or other material between the kerf lines.

There are additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description. The invention is capable of other embodiments and of being practiced and carried out in various ways. Also, it is to be understood that the phraseology and terminology employed herein are for the purpose of description and should not be regarded as limiting. In this regard, the term "drill string" is employed herein to interchangeably refer to a string of drill pipe(s) or casing(s) or tubing(s). As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

BRIEF DESCRIPTION OF THE DRAWINGS

FIG. 2 is an elevational view showing one of the blades including fluid delivery system in the cutting position;

FIG. 3 is a bottom plan view of the blade shown in FIG. 2;

FIG. 4 is an elevational view of the blade shown in FIG. 2 with the blade being shown at rest;

DETAILED DESCRIPTION OF PREFERRED EMBODIMENT

Figure 1:
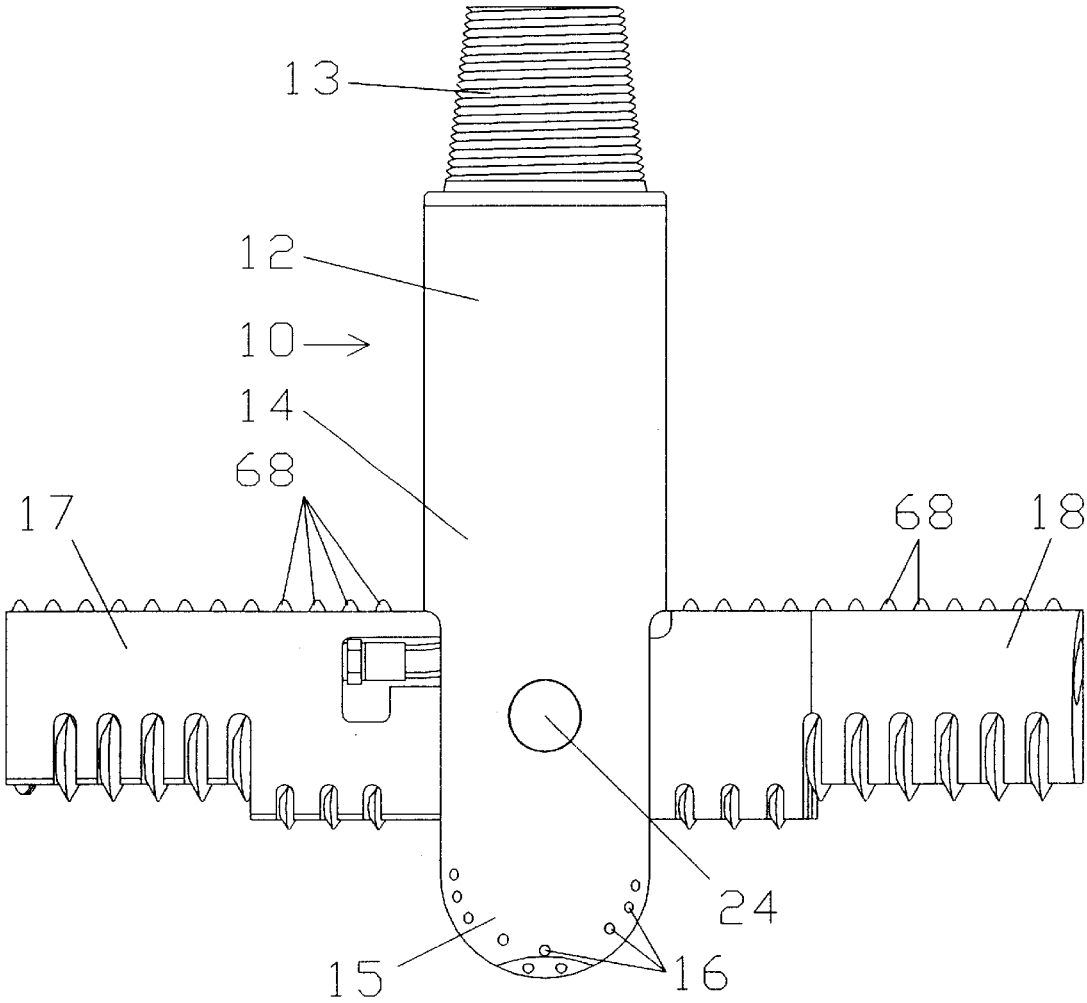
FIG. 1 is an elevational view of a preferred form of reaming tool in accordance with the present invention and illustrating the cutter blades of the assembly in their cutting position.
Figure 5:
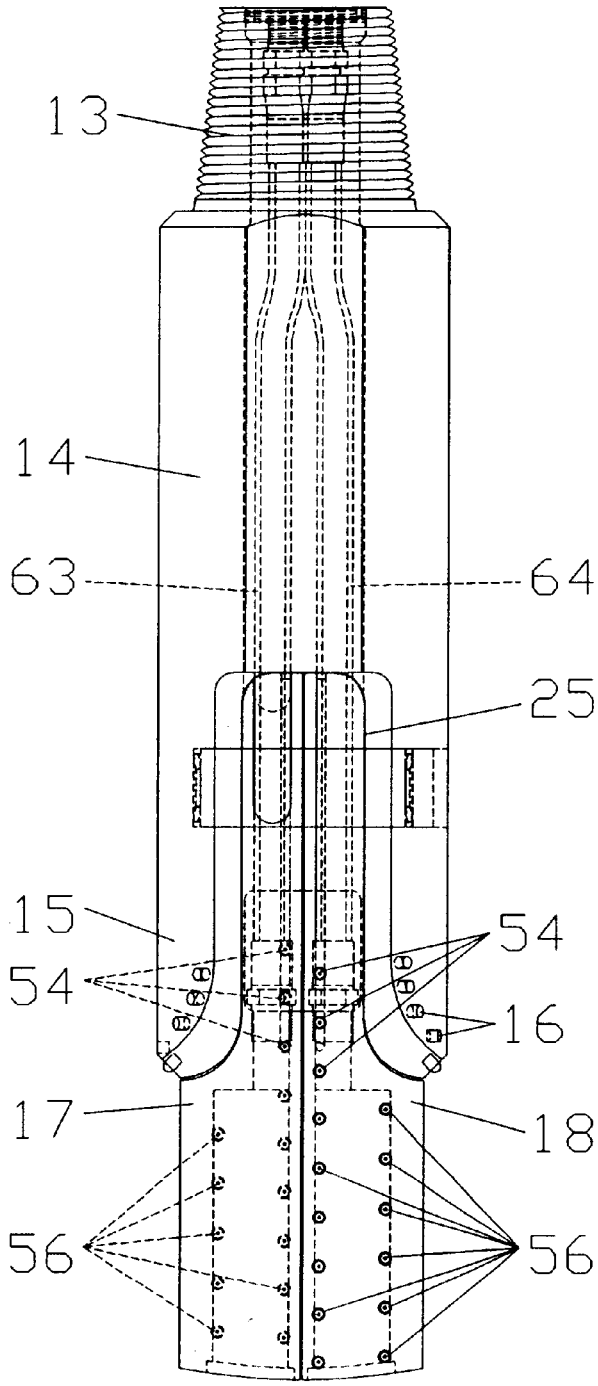
FIG. 5 is an elevational view of the reaming tool shown in FIG. 1 but with the blades shown at rest.

Referring to the drawings, there is illustrated in FIGS. 1 to 8 a preferred form of reaming tool 10 which is comprised of a sub 12 in the form of a hollow cylindrical body having an upper threaded end 13 and a bifurcated pivotal end 14 which terminates in a rounded leading end or nose 15. The nose may be provided with a plurality of cutting elements 16, although in most formations it will operate as effectively as a guide without the cutting elements 16. As best seen from FIGS. 9A to 9D and 10A to 10D, a pair of blades 17 and 18 are each made up of an elongated blade arm 20 tapering into a rounded pivotal end 22 having a transverse opening 23 for insertion of a common pivot pin 24 through aligned openings in the lower pivotal ends 14 of the sub 12. Each blade arm 20 is of generally semi-circular configuration having a flat surface portion 19. Thus the blades 17 and 18 are supported for pivotal movement between a first position extending substantially in a lengthwise direction when at rest and a transverse or mutually perpendicular direction when in operation as illustrated in FIGS. 5 and 1, respectively. The pivotal ends 14 are in the form of ears or extensions of the hollow cylindrical sub body 12 so as to be arcuate in cross-section and have a series of fixed cutting inserts 16 at spaced intervals along their external surface portions.

Each of the blades 17 and 18 has a generally concave surface portion 28 tapering into the pivotal end 22 and which surface portion 28 is complementary to the convex surface portion 15. In turn, the pivotal ends 22 are of a thickness such that when mounted on the pivot shaft 24 will clear the arcuate edges 25 of the pivotal end 14 so that the blade arms are free to swing freely into and away from the mutual perpendicular positions shown in FIG. 1 with their flat surface portions 19 in closely spaced confronting relation to one another.

Each of the blade arms 20 includes radially offset larger and smaller semi-circular body portions 30 and 32, the larger portion 32 extending along the inner radial surface of the arm 20 adjacent to the pivotal end 22. The smaller portion 30 is of approximately the same length as the larger portion 32 and terminates in an outer squared distal end 34 of the arm. In the smaller surface portion 30, a series of first cutter disks 36 are mounted for rotation about individual roller shafts 37 which are fixed in recesses in the undersurface of each of the blade arms 20 and at uniform, axially spaced intervals along the undersurface of each arm adjacent to the flat surfaces 19. As best seen from FIGS. 2 and 3, the axis of rotation for each disk is such as to correspond to the radius of curvature which that disk follows. In other words, the shaft 37 for that disk is perpendicular to the radius of curvature at that point on the undersurface of the arm 20. The individual disks 36 are of a hardened material, such as, tungsten carbide material and have tapered surfaces which terminate in a common cutting edge 38.

The radially inner body portion 32 is provided with relatively small cutter disks 40 which are mounted for rotation about individual shafts 42. The disks 40 are oriented in a manner corresponding to that described with reference to the larger disks 36 so as to follow the circular path of rotation at that radius from the center or pivotal axis 24. The disks 40 are similarly arranged to extend along the undersurface or leading edge of the blade arm but in slightly trailing relation to the larger disks 36, as best seen in FIG. 3.

Figure 8:
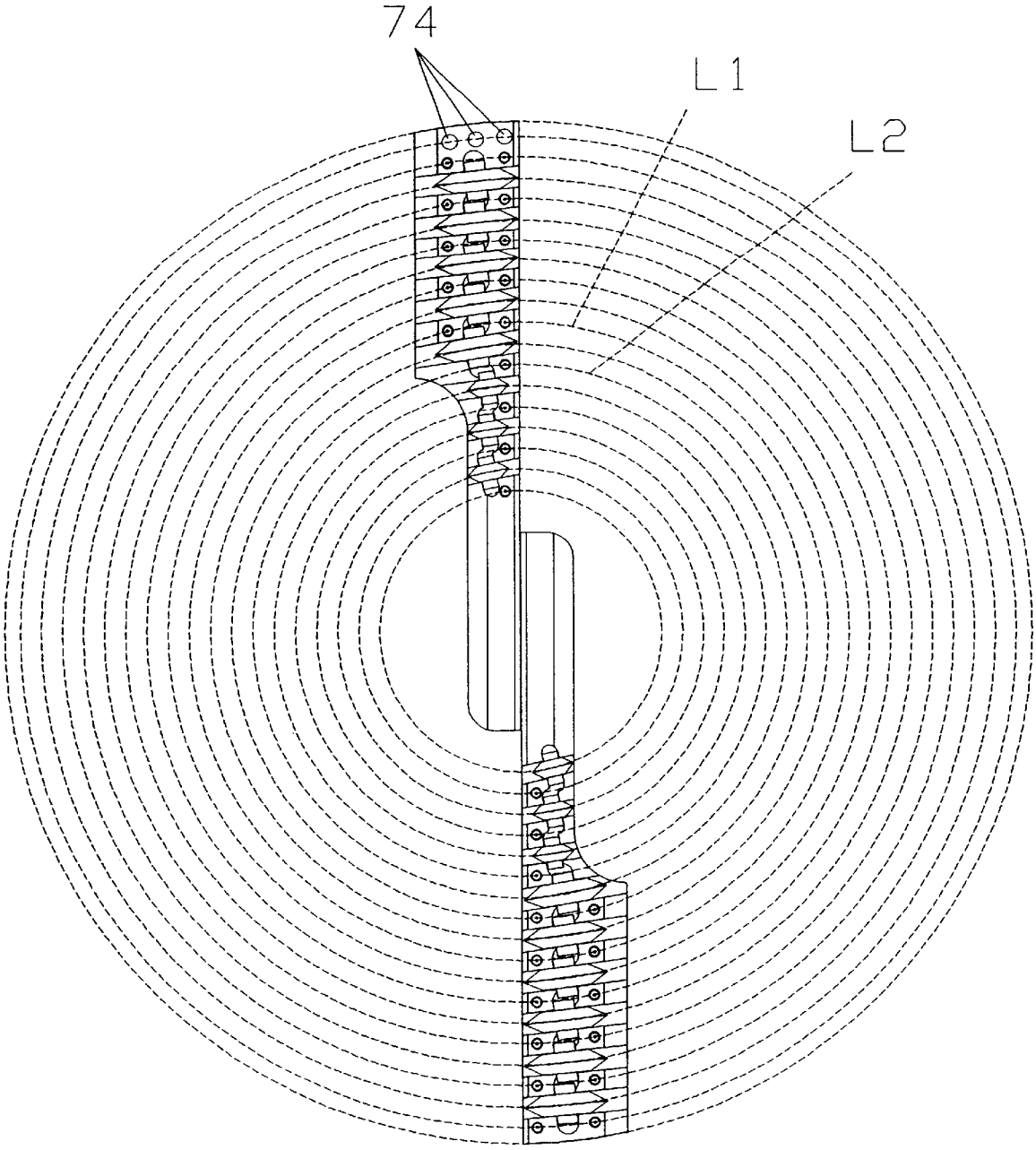
FIG. 8 is a bottom plan view of the preferred form of reaming tool and illustrating the kerf lines formed during the earth boring operation.

As shown in FIGS. 2 to 4, each blade arm 20 includes a main fluid delivery passage 48 extending radially of the arm and communicating with an enlarged passage 50 within the arm directly behind the larger cutter disks 36. The fluid passage 48 also communicates with a smaller channel 52 which extends transversely of the passage 48 and communicates with channel 53 extending lengthwise of the blade arm 20 directly behind the smaller disks 40 in the larger portion 32 of the body. A plurality of discharge nozzles or jets 54 extend from the channel 53 through the portion 32 to discharge fluid under pressure from the blade arms at a location in close proximity to the cutter disks 40 so as to form a series of kerf cutting lines $L_1$ as represented in FIG. 8.

Figure 6:
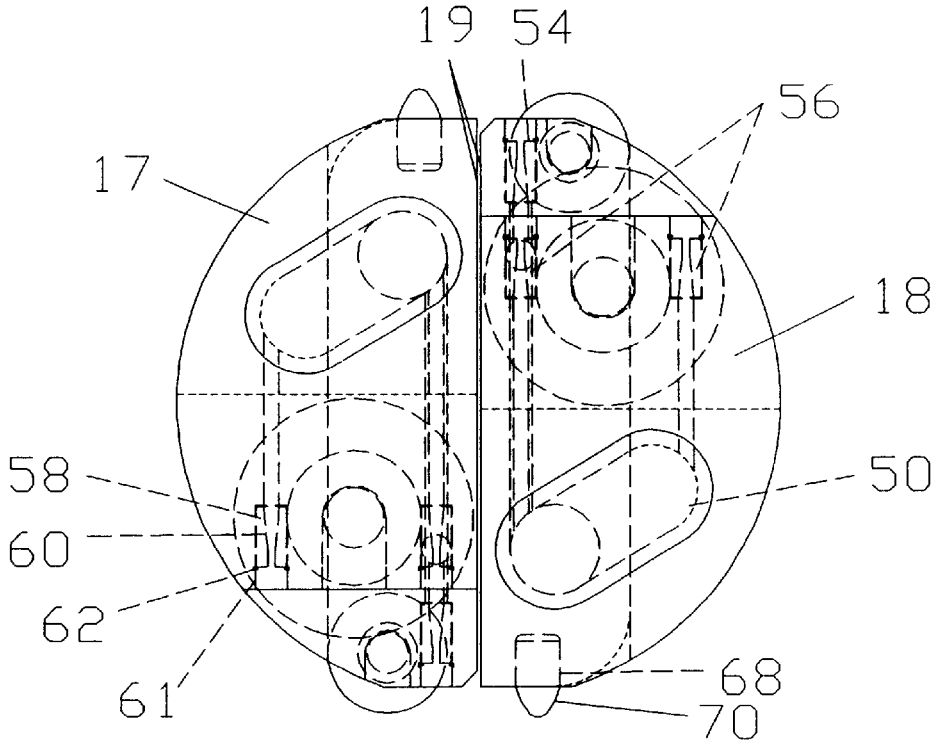
FIG. 6 is an enlarged end view of the preferred reaming tool shown in FIG. 5.

The main fluid passage 50 also communicates with dual jet discharge nozzles 56 via a pair of passages 55 in the larger body portion 30 of each blade arm, there being a pair of nozzles 56 which discharge fluid into the formation adjacent to each larger cutter disk 36 fore and aft of the shafts 37 as illustrated. The nozzles 56 form kerf cutting lines as represented at $L_2$ in FIG. 8. As shown in FIG. 6, each of the nozzles 54 and 56 is in the form of a hollow cylindrical body 58 having a venturi-shaped bore 60 which converges towards its discharge end, and the body 58 is mounted within a counterbore 61 and secured therein by a retainer ring 62.

Figure 7:
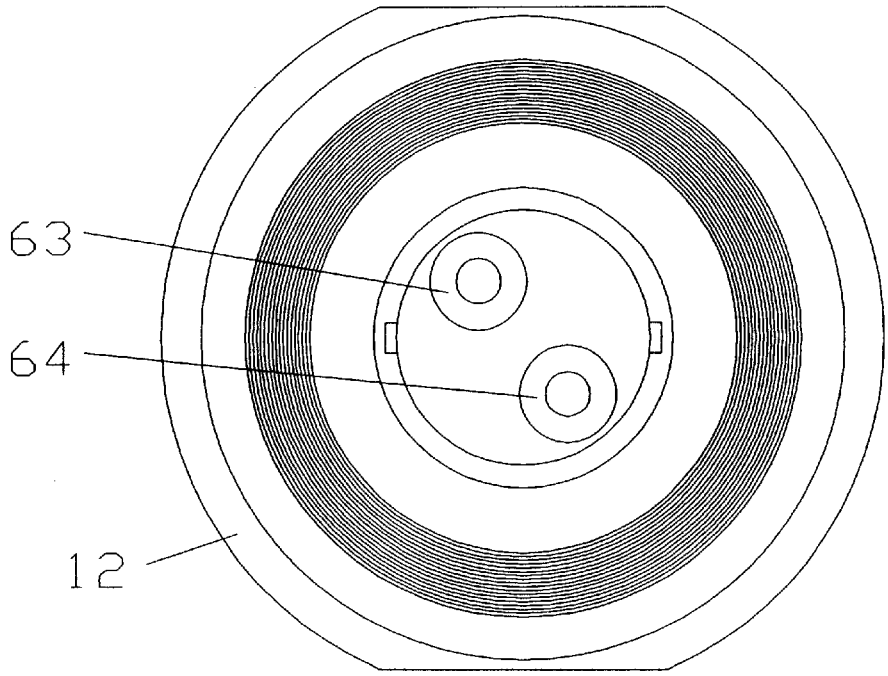
FIG. 7 is an opposite end view to that of FIG. 6.

Having further reference to FIGS. 5 to 7, a pair of flexible fluid delivery hoses 63 and 64 extend downwardly through the hollow body 12 and are threadedly connected as at 66 to the inner radial ends of the channels 48 of each of the blades 17 and 18. The hoses 63, 64 are in communication with fluid pumped through the drill string or casing string, not shown, from which the sub 12 is suspended. In this manner, the delivery hoses 63, 64 will easily bend or flex in following the pivotal movement of the cutter blades during the drilling operation while maintaining a tight seal with the passages 48.

A series of cutting inserts 68 of a hardened cutting material are inserted in circular recesses along the trailing edge of each blade 17 and 18. Each insert 68 is of generally elongated cylindrical configuration having a tapered end 70 which protrudes from the trailing edge in order to cut into the formation when the blades 17 and 18 are rotated. The cutting inserts 68 are most useful in the event of formation hole collapse, hole sloughing or hole swelling. Under continued rotation and/or frictional force engagement and/or fluid discharge force, the blades 17 and 18 will gradually swing or pivot outwardly into their mutually perpendicular position as shown in FIG. 1. At that point, the cutter disks 36 and 40 will gradually move into cutting engagement with the formation. Along with the cutting inserts 26 on the bifurcated end surfaces 16 of the sub 12, cutting inserts 73 may be positioned along at least a limited portion of the leading edge of each inner blade portion 32, and cutting inserts 74 are positioned at outer distal ends of the blades 17 and 18.

Figure 9A:
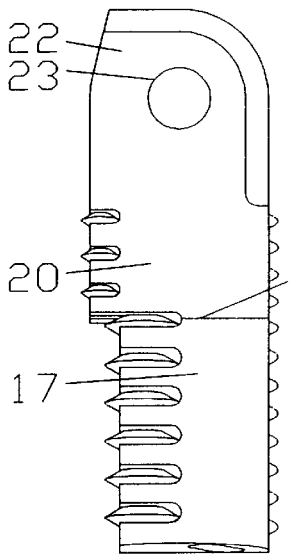
FIGS. 9A to 9D are elevational views of the front, side, rear and opposite side respectively of one of the cutter blades.
Figure 9B:
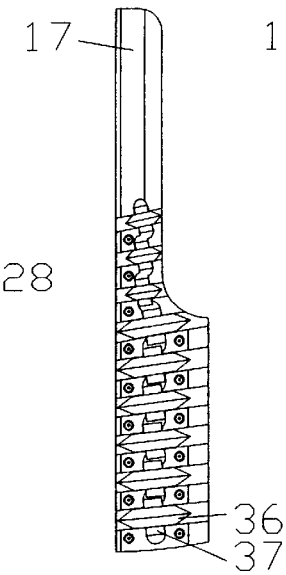
Figure 9C:
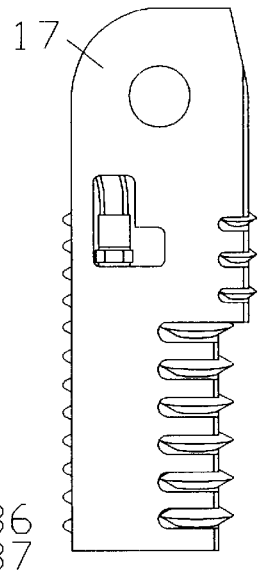
Figure 9D:
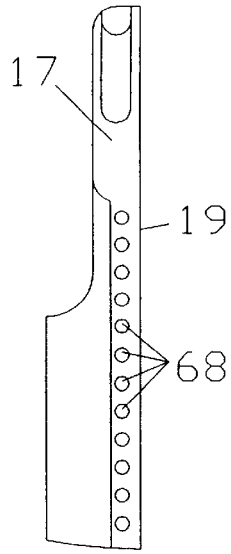
Figure 10A:
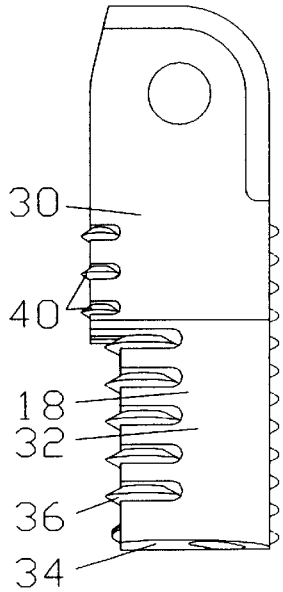
FIGS. 10A to 10D are elevational views of the front, side, rear and opposite side respectively of another of said cutter blades.
Figure 10B:
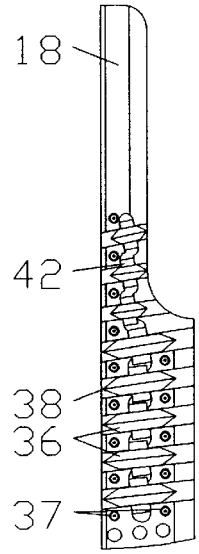
Figure 10C:
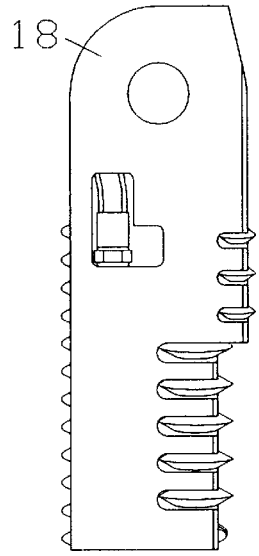
Figure 10D:
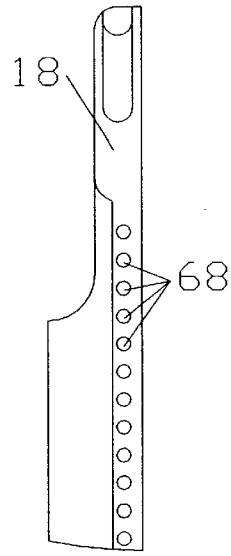

As seen from a comparison of FIGS. 9A to 9C with 10A to 10C, the cutter disks 36 and 40 on one blade arm 17 are offset with respect to the cutter disks 36 and 40 on the other blade arm 18. Correspondingly, the nozzles 54 and 56 on the one blade arm 17 are offset or staggered with respect to the nozzles 54 and 56 on the other blade arm 18. The primary function of the nozzles is to form the kerf lines $L_1$ and $L_2$ as illustrated in dashed form in FIG. 8 as described. In turn, the cutter disks 36 and 40 are operative to break up the rock between the kerf lines $L_1$ and $L_2$ and therefore are aligned between the nozzles 54 and 56 of their respective blade arms.

In operation, the reaming tool is threaded onto the lower end of a conventional drill string or other rotatable drive means. The reaming tool is then lowered beyond the cased portion of the earth bore into a position where the blades are at a point at which it is desired to enlarge the bore or to form a cavern. Under rotational force applied to the drill string, the blades 17 and 18 will gradually expand outwardly as the cutter inserts 68 initially cut into the surrounding formation and gradually advance into a position substantially perpendicular to the drill pipe as shown in FIG. 1. Outward expansion of the blades is further assisted by application of fluid under pressure through the hoses 63 and 64 which is discharged in the form of high velocity jet streams by the nozzles 54 and 56. The fluid which is pumped through the nozzles or jets in forming the kerf cutting lines $L_1$ and $L_2$ will further assist in removing the cuttings upwardly between the drill string and face of the bore to the surface. Under continued downward advancement, the leading end 15 will effectively guide the tool through the existing bore and discourage any tendency of the tool to alter its course away from the existing bore. In turn, the cutter disks 36 and 40 will in cooperation with the discharge jets perform the major role in cutting to substantially enlarge the diameter of the well bore.

As shown and described in my hereinbefore referred to U.S. Pat. No. 5,494,121, the drill string is continuously rotated and lowered to form a cavern in which the top wall is substantially perpendicular to the drill string; or a sloped top wall may be formed with a slower rotational speed. The cutter blades 17 and 18 have lengths equal to the radius of the desired bore or cavern, or shorter length blades may be employed in the event that the well bore is to be progressively enlarged due to formation characteristics or available rotational force. By cutting an enlarged diameter well bore through the producing formation, the production flow rate is substantially increased by increasing the surface area of the pressurized reservoir formation open to communicate with the interior of the less pressurized well bore and due to the enlarged collection volume area of the well bore itself. Other benefits include the ability to provide an enlarged area for other wells to intersect the enlarged bore or cavern as well as an enlarged area for other downhole tools to work within the bore and a larger footprint area for structural or cement limitations on the size of disks that can be employed adjacent to the lower pivotal end 14. The function of the larger disk is to provide an increased cutting surface area in traversing greater distances at the outer distal ends of the blades 17 and 18. It will be apparent that fluid channels other than the hoses 63 and 64 can be employed to direct fluid under pressure into each of the blades 17 and 18. However, the hoses 63 and 64 offer a more secure and durable fluid delivery passage while avoiding the necessity of seals between moving surfaces. The larger cutting disks 36 employed along the smaller surface portion 30 may be varied in size, and it is not particularly critical whether the large disks 36 are in trailing relation to the smaller disks 40 and is more a matter of dimensioning the disks 36 and 40 to best fit into the body portions 30 and 32 and leave adequate space for the fluid delivery passages.

DETAILED DESCRIPTION OF MODIFIED FORMS OF INVENTION

Figure 11:
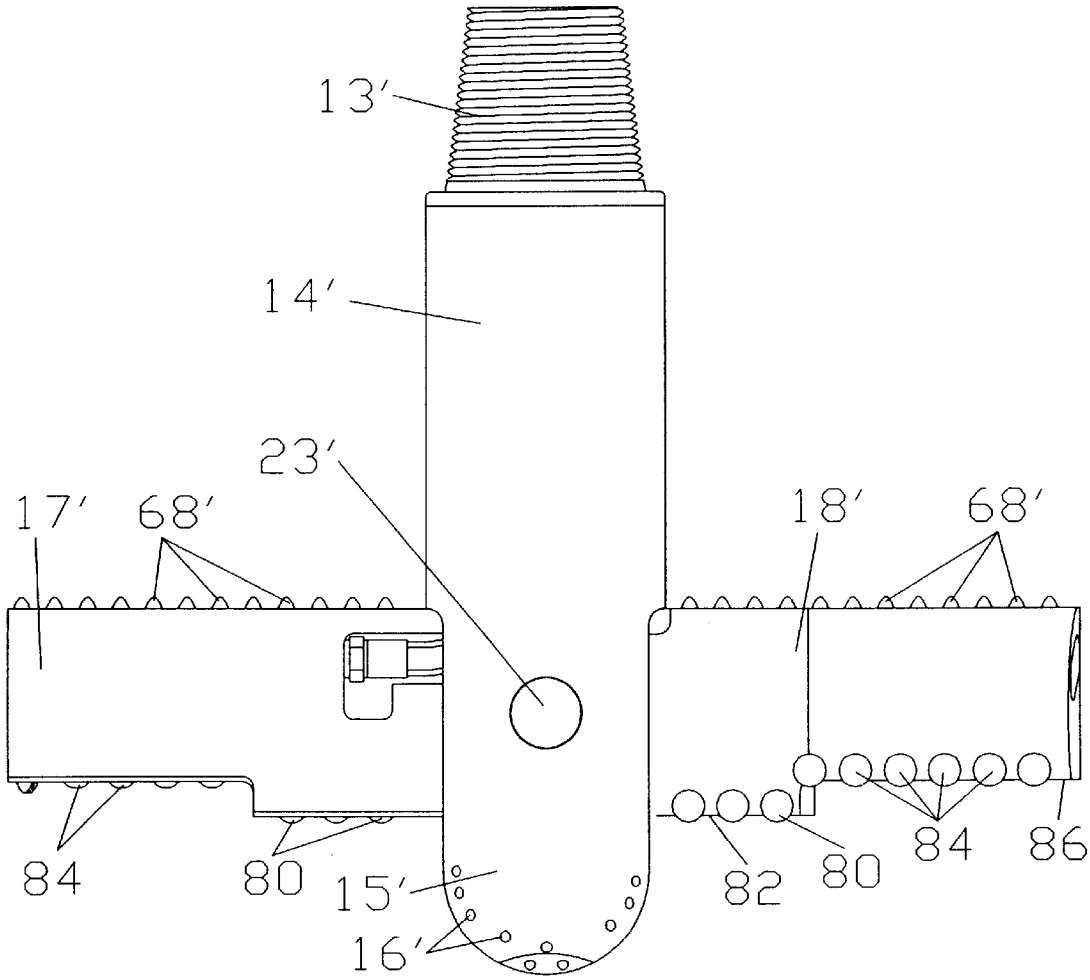
FIG. 11 is an elevational view of a modified form of reaming tool provided with a series of stationary cutters and cutting inserts thereon.
Figure 11A:
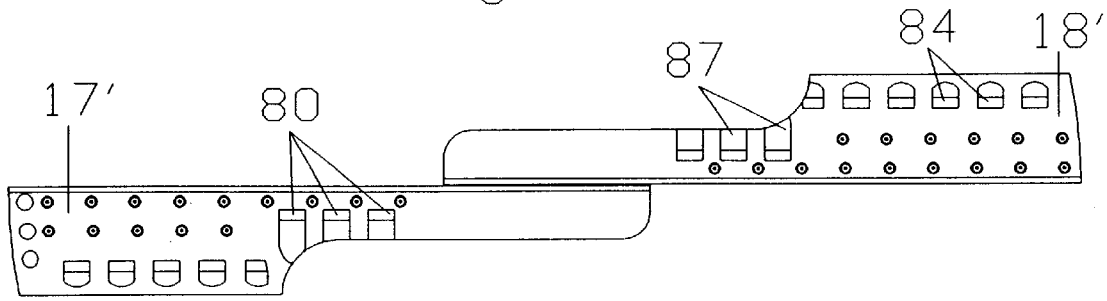
FIG. 11A is a bottom plan view of the cutter blades shown in the modified form of FIG. 11.

Modified forms of invention are illustrated in FIGS. 11, 11A and 12, 12A in which like parts to those in the preferred form are correspondingly enumerated. Referring to FIGS. 11, 11A, in place of rotatable cutting disks 36 and 40, stationary cylindrical cutting elements 80 are inserted at radially spaced intervals along radially inner leading edge 82 of each cutter blade 17' and 18'. Specifically, the cutting elements 80 have their centers on axes extending normal to the leading edge 82 and parallel to that of the pivot 23' of the cutting blades. Similarly, cylindrical stationary cutting inserts 84 are disposed in outer offset leading edge portions 86 at radially spaced intervals with their axes aligned with those of the elements 80. Both with respect to the elements 80 and 84, the greater circumference of each is embedded in bores 87 in the body of the cutting blades 17' and 18' so that only a limited circumferential portion projects beyond the leading edge 82 or 86. Additional cutting inserts 68' corresponding to those of the preferred form are radially spaced along the trailing edges of the blades 17' and 18'.

Figure 12:
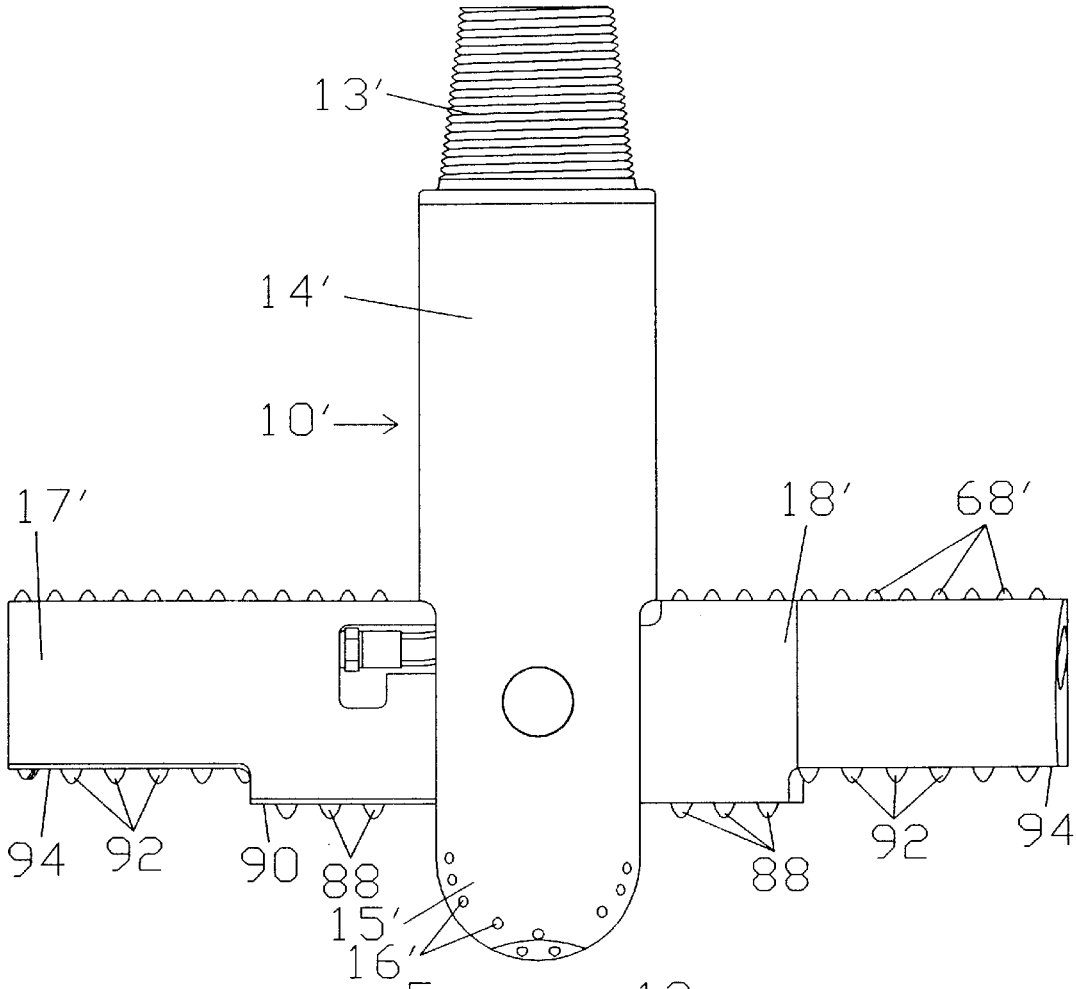
FIG. 12 is an elevational view of another modified form of invention provided with a series of cutting inserts thereon.
Figure 12A:
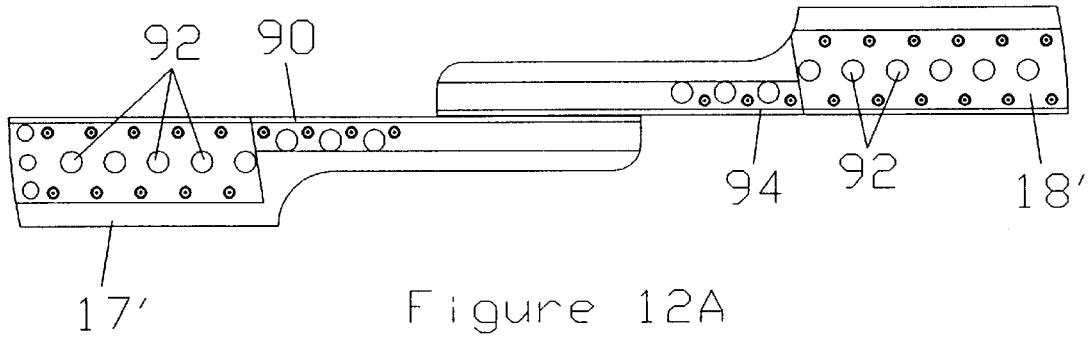
FIG. 12A is a bottom plan view of the modified form of cutter blades shown in FIG. 12.

Another modified form of drill bit is illustrated in FIG. 12 wherein stationary cutting elements 88 are radially spaced along radially inner leading edge portions 90 of each of the cutter blades 17' and 18' and are dimensioned and mounted in the body of the blades 17' and 18' in the same manner as described with reference to the cutting inserts 68 of the preferred form. The same applies to cutting inserts 92 that are arranged in radially spaced relation to one another along the radially outer leading edge portions 94.

Figure 13:
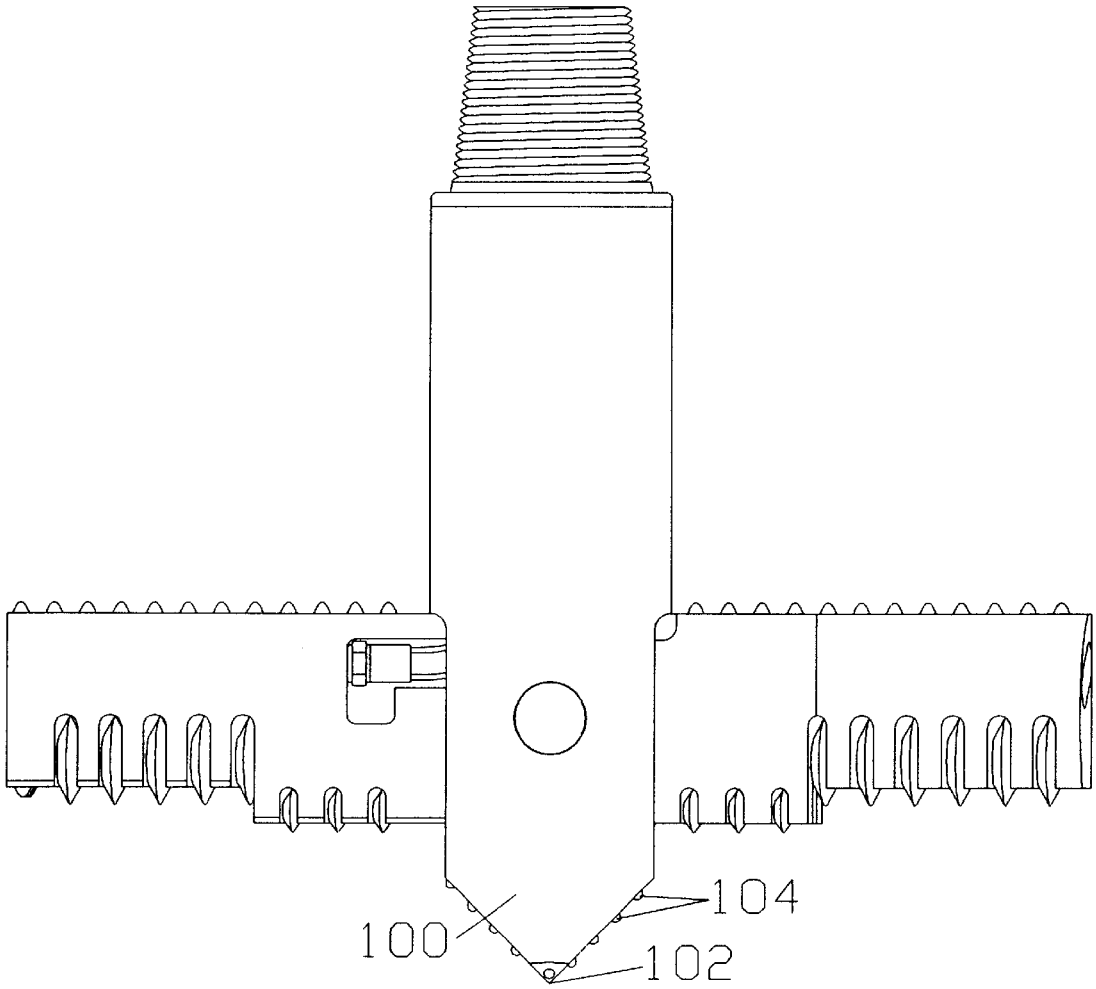
FIG. 13 is an elevational view of a modified form of reaming tool having a sub with a generally conical leading end.

FIG. 13 illustrates another modified form of invention which corresponds in all respects to FIG. 1 but is provided with a generally conical leading end 100 which terminates in the pointed edge 102 and is provided with a plurality of cutting inserts 104. As in the preferred form, the conical end 100 will serve as an effective guide in advancing through established bores in a formation during the underreaming operation.

The selection of cutting blades as described in the preferred and modified forms is dictated primarily by the hardness of the formation and drilling speed. Typically, the cutting elements described in the modified forms would be better suited for softer formations than the rotatable cutter disks 36 and 40 of the preferred form and will cooperate in the same manner with the fluid discharge jets in advancing through the formation.

It is therefore to be understood that while a preferred and modified forms of invention are herein set forth and described the above and other modifications and changes may be made therein without departing from the spirit and scope of the invention as defined by the appended claims and reasonable equivalents thereof.

I claim:

1. A reaming tool for enlarging an earth bore in a subsurface formation wherein rotational drive means is lowered through the earth bore to a point at which it is desired to enlarge the bore, comprising:

a body connected to said drive means;

a plurality of elongated cutter blades pivotally secured to a lower end of said body for downward extension beyond a lowermost point of said lower end; and fluid delivery means communicating with a fluid delivery passage in each said blade for delivery of fluid under pressure therethrough, and a plurality of fluid discharge nozzles communicating with said passage in each said blade.

2. A reaming tool according to claim 1 wherein said fluid discharge nozzles are disposed along leading edges of said blades.

3. A reaming tool according to claim 1 wherein each of said blades includes spaced cutting elements, and said cutting elements are of increased size in an outward radial direction along each of said blades.

4. A reaming tool according to claim 3 wherein said cutting elements are of increased diameter in an outward radial direction along each of said blades.

5. A reaming tool according to claim 4 wherein said fluid discharge nozzles are positioned between said cutting elements.

6. A reaming tool according to claim 1 wherein said fluid delivery means includes a flexible hose for delivering fluid under pressure through said body into said passage in each said blade.

7. A reaming tool according to claim 1 wherein each of said blades includes a plurality of radially spaced cutting elements along a trailing edge thereof.

8. A reaming tool according to claim 3 wherein a plurality of smaller cutting elements are mounted in each said blade at radially spaced intervals along a radially inner portion of said blade and a plurality of larger cutting elements are mounted at radially spaced intervals in an outer radial portion of said blade.

9. A reaming tool according to claim 8 wherein said fluid delivery passage in each said blade communicates with a first channel for delivering fluid under pressure to said fluid discharge nozzles adjacent to said radially inner cutting elements and communicates with a plurality of channels for delivery of fluid under pressure to said fluid discharge nozzles adjacent to said radially outer cutting elements.

10. A reaming tool according to claim 9 wherein a pair of said fluid discharge nozzles are mounted in fore and aft relation to one another between adjacent of said radially outer cutting elements.

11. A reaming tool according to claim 1 wherein a pair of said blades are pivotally secured to said body, each of said blades being of generally semi-circular cross-sectional configuration, said blades being movable in opposite directions to one another from a position extending substantially in a direction parallel to the rotational axis of said drill string and a position extending substantially in opposite perpendicular directions to the rotational axis of said drill string in response to centrifugal force from rotation and/or frictional force from engagement with formation and/or delivery of fluid under pressure through said fluid discharge nozzles.

12. A reaming tool for enlarging an earth bore in a subsurface formation wherein rotational drive means is lowered through the earth bore to a point at which it is desired to enlarge the bore, comprising:

a sub connected to a lower end of said drive means;

a pair of elongated cutter blades pivotally secured to a lower end of said sub, said lower end being bifurcated and including cutting elements thereon;

each of said blades being of generally semi-circular cross-sectional configuration, said blades having flat surface portions in confronting relation to one another;

a pivot shaft mounting said blades between said bifurcated lower end portions of said sub for pivotal movement between extension in a common axial direction and extension in opposite perpendicular directions to one another;

a plurality of cutter elements extending along leading and trailing edges of said blades; and fluid delivery means extending through said sub into communication with a fluid delivery passage in each of said blades, and a plurality of fluid discharge nozzles extending through said leading edges of said blades perpendicular to said flat surface portions.

13. A reaming tool according to claim 12 wherein said blades include rotatable cutter elements along a leading edge thereof.

14. A reaming tool according to claim 13 wherein said cutter elements are disposed in offset portions of said blades.

15. A reaming tool according to claim 14 wherein said fluid discharge nozzles extend between said cutter elements.

16. A reaming tool according to claim 13 wherein said cutter elements are of increased size in an outward radial direction along each of said blades.

17. A reaming tool according to claim 16 wherein said cutter elements are disks of increased diameter in an outward radial direction along each of said blades.

18. A reaming tool according to claim 17 wherein said fluid delivery means includes a flexible hose for delivering fluid under pressure through said sub into said passage in each said blade.

19. A reaming tool according to claim 12 wherein each of said blades includes a plurality of radially spaced cutter elements along a trailing edge thereof.

20. A reaming tool according to claim 17 wherein said cutter elements include a plurality of smaller cutter elements mounted in each said blade at radially spaced intervals along a radially inner portion of said blade and a plurality of larger cutter elements mounted at radially spaced intervals in an outer radial portion of said blade.

21. A reaming tool according to claim 20 wherein said fluid delivery passage in each said blade communicates with a first channel for delivering fluid under pressure to said fluid discharge nozzles adjacent to said radially inner cutter elements and communicates with a second channel for delivery of fluid under pressure to said fluid discharge nozzles adjacent to said radially outer cutter elements.

22. A reaming tool according to claim 21 wherein pairs of said fluid discharge nozzles are mounted in fore and aft relation to one another between adjacent of said radially outer cutter disks.

23. In a reaming tool for enlarging an earth bore in a subsurface formation wherein rotational drive means is lowered through the earth bore to a point at which it is desired to enlarge the bore and wherein a plurality of elongated cutter blades are pivotally secured to a lower end of said drive means, the method comprising:

rotating said reaming tool to force said blades outwardly into engagement with said formation;

discharging a high velocity stream of fluid through fluid discharge jets in at least one of a pair of said blades whereby to form a series of kerf lines in concentric circles;

placing cutter elements on at least one other of said blades to break up the formation of material between the kerf lines formed by the jet streams through the nozzles; and orienting said cutter elements to follow said kerf lines to assist in breaking up the formation between the kerf lines.

24. The method according to claim 23 wherein said fluid discharge jets are disposed along said formation-engaging surfaces.

25. The method according to claim 23 wherein said cutter elements are of increased size in an outward radial direction along each of said blades.

26. The method according to claim 25 wherein said cutter elements are of increased diameter in an outward radial direction along each of said blades.

27. The method according to claim 23 wherein said fluid discharge nozzles are positioned between said cutter elements.

28. The method according to claim 23 wherein said fluid delivery passage in each said blade communicates with a first channel for delivering fluid under pressure to said fluid discharge nozzles adjacent to said radially inner cutter elements and communicates with a second channel for delivery of fluid under pressure to said fluid discharge nozzles adjacent to said radially outer cutter elements.

29. The method according to claim 23 including the step of moving said blades in opposite directions to one another from a position extending substantially in a direction parallel to the rotational axis of said drill string and a position extending substantially in opposite perpendicular directions to the rotational axis of said drill string in response to centrifugal force from rotation and/or functional force from engagement with formation and/or delivery of fluid under pressure through fluid discharge jets.

* * * * *